US006718875B2

(12) United States Patent
Ono

(10) Patent No.: US 6,718,875 B2
(45) Date of Patent: Apr. 13, 2004

(54) APPARATUS FOR EXTRACTING AND CONVEYING PRINTING PLATES

(75) Inventor: Tsukasa Ono, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/125,432

(22) Filed: Apr. 19, 2002

(65) Prior Publication Data

US 2002/0152910 A1 Oct. 24, 2002

(30) Foreign Application Priority Data

Apr. 23, 2001 (JP) ..... 2001-124205

(51) Int. Cl.[7] ..... B65H 3/08; B65H 3/54

(52) U.S. Cl. ..... 101/477; 271/9.08; 271/105; 271/11; 271/104; 271/161

(58) Field of Search ..... 101/477, 479, 101/480; 271/9.05, 9.08, 9.11, 105, 107, 186, 11, 104, 106, 161, 162, 164, 170; 414/796.4, 797, 758, 773, 783, 416.03, 416.08

(56) References Cited

U.S. PATENT DOCUMENTS 5,256,022 A * 10/1993 Neudecker ..... 414/416.07
5,560,596 A * 10/1996 Okoda et al. ..... 271/106
5,991,593 A * 11/1999 Sugiyama ..... 399/388
6,341,932 B1 * 1/2002 Otsuji ..... 414/403
6,422,801 B1 * 7/2002 Solomon ..... 414/416.07

FOREIGN PATENT DOCUMENTS

EP 1 061 019 A2 * 12/2000
JP 60-232340 * 11/1985
JP 2-13523 * 1/1990

* cited by examiner

*Primary Examiner*—Leslie J. Evanisko
(74) *Attorney, Agent, or Firm*—Sughrue Mion, PLLC

(57) ABSTRACT

An apparatus for extracting and conveying a printing plate. The apparatus includes separation plates disposed at corners of a cassette accommodating at least printing plates. Air enters between an uppermost printing plate that is extracted and an underlying printing plate or an interleaf sheet, thereby separating the uppermost printing plate from the underlying printing plate or the interleaf sheet. Guide rails disposed above the cassette are parallel to a bottom of the cassette. Movable/rotatable bodies are disposed on the guide rails so as to be movable along the guide rails and be rotated about 180° within moving ranges, such that the uppermost printing plate is sent into an exposure section with an emulsion surface of the printing plate facing up.

14 Claims, 12 Drawing Sheets

APPARATUS FOR EXTRACTING AND CONVEYING PRINTING PLATES

BACKGROUND OF THE INVENTION

1. Field of the Invention

The present invention relates to an apparatus and a method for extracting an uppermost printing plate from a stack of printing plates accommodated in a cassette and conveying the extracted printing plate to a processing section.

2. Description of the Related Art

Apparatus have been developed in which it has become possible to quickly and directly record, by exposure with a laser beam or the like, an image on a printing plate comprising a support having disposed thereon an image forming layer. Such apparatus typically include a cassette that accommodates a stack of printing plates. The cassette is disposed substantially parallel to a surface on which the apparatus is placed, with the printing plates being stacked on a base of the cassette.

The printing plates are extracted from the cassette one at a time and conveyed to a section where the printing plates are exposed. In order to extract the uppermost printing plate from the cassette, the uppermost printing plate is usually sucked by suckers and guided along guide rails to the exposure section.

In this case, it is necessary to uniformly arrange and dispose the suckers substantially parallel to the surface of the uppermost printing plate, and move the suckers so that the uppermost printing plate is evenly sucked and lifted. However, the following problems arise.

Firstly, the area of contact between adjacent printing plates is large and the contact is close. Therefore, when the uppermost printing plate is to be separated from the underlying printing plate, an excessive amount of sucking force is necessary. It is also necessary to ensure that the uppermost printing plate is separated from the underlying printing plate by, for example, swinging the uppermost printing plate after it has been sucked and slightly lifted by the suckers.

Secondly, the path along which the extracted printing plate is conveyed to the exposure section is not only long, but must be disposed with a plurality of rollers, which leads to an increase in the number of parts necessary for the apparatus.

Additionally, depending on the printing plate, it is not always possible for the printing plate to be suckingly extracted by the suckers due to the vulnerability of the image forming layer. In order to cope with this problem, the printing plates are stacked so that surfaces opposite to the surfaces on which the image forming layers are disposed face up, so that the surface of the printing plate that is sucked by the suckers is the surface of the printing plate opposite to the surface on which the image forming layer is formed.

In this case, however, the extracted printing plate needs to be inverted during conveyance to the exposure section. If extraction, inversion, and conveyance of the printing plates are separately controlled, systems for driving and controlling these operations become complicated.

SUMMARY OF THE INVENTION

In view of the above-described facts, an object of the present invention is to obtain an apparatus and a method for extracting an uppermost printing plate from a stack of printing plates accommodated in a cassette and conveying the extracted printing plate by rollers or the like along a shorter conveyance path to a processing section without scratches being formed on an image forming layer of the printing plate.

Another object of the present invention is to obtain an apparatus and a method for extracting and conveying a printing plate in which the printing plate can be extracted, inverted, and conveyed to a processing section in one operation.

A first aspect of the present invention is an apparatus for extracting an uppermost printing plate from a cassette in which printing plates are stacked and conveying the extracted printing plate to a processing section, the apparatus comprising: movable bodies, each of which are movable along a guide rail disposed between the cassette and the processing section; a holding member disposed at each of the movable bodies and movable towards and away from ends of the printing plates in the cassette opposite to ends disposed near the processing section, the holding member holding the uppermost printing plate as the holding member is moved towards the uppermost printing plate and separating the uppermost printing plate from an underlying printing plate as the holding member is moved away; separation members provided at end corners of the cassette opposite to end corners disposed near the processing section, the separation members curving the uppermost printing plate while the holding member separates the uppermost printing plate from the underlying printing plate; a moving device for moving each of the movable bodies along the guide rail to the processing section while the holding member holds the uppermost printing plate; and a rotation device for rotating the uppermost printing plate held by the holding member at a predetermined radius of curvature while the movable bodies are moved by the moving device, such that the uppermost printing plate is inverted.

According to the apparatus of the first aspect, the movable bodies are moved along the guide rails and made to face the cassette. The holding member approaches the stack of the printing plates accommodated in the cassette, holds the uppermost printing paper, and is moved away from the stack while holding the uppermost printing plate. At this time, the printing plate interferes with the separation members and is curved, for example. Because of this curve, air enters between the uppermost printing plate and the underlying printing plate. As a result, separation of the uppermost printing plate from the underlying printing plate is improved, and only the uppermost printing plate is reliably extracted from the cassette.

The extracted printing plate is conveyed to the processing section by the movable bodies being moved along the guide rails. Along with this movement, the holding member is rotated at a predetermined radius of curvature. By the rotation of the holding member, the printing plate is taken out so that the end of the printing plate opposite to the end near the processing section is lifted, and the printing plate is inverted and sent into the processing section. Due to the inversion, the surface of the printing plate opposite to the surface on which the image forming layer is formed can be held by the holding member, and the image forming layer can be prevented from being scratched by the holding member.

Further, immediately after the holding member holds the printing plate, the printing plate is still supported by the underlying printing plate except for the portion held by the holding member, namely, the end opposite to the end near the processing section, and the area of the printing plate supported by the underlying printing plate is gradually decreased. Therefore, holding power of the holding member does not need to be increased more than necessary.

Furthermore, the printing plate is conveyed along with the rotational movement of the rotation device. Accordingly, the path along which the printing plate held by the holding member is conveyed can be shortened.

In the apparatus of the first aspect, plural cassettes are preferably stacked in a direction that is the same as the direction in which the printing plates are stacked, and the apparatus further includes a device for retracting cassettes accommodating printing plates not in use, such that the cassette accommodating printing plates to be used faces the holding member.

According to the apparatus of the first aspect, plural cassettes are stacked in the direction which is the same as the direction in which the printing plates are stacked. For example, when the cassettes are disposed parallel to a surface on which the apparatus is placed, the cassettes except the uppermost cassette are hidden by cassettes disposed above them. Therefore, cassettes other than the cassette accommodating printing plates to be conveyed to the processing section are retracted such that the cassette accommodating printing plates to be used faces the holding member. Namely, the cassette in use is not moved.

When the cassettes are stacked parallel to the surface on which the apparatus is placed as described above, it suffices if the cassettes accommodating printing plates not in use are moved parallel to the surface on which the apparatus is placed.

A second aspect of the present invention is an apparatus for extracting an uppermost printing plate from a cassette, in which printing plates and interleaf sheets for protecting image forming surfaces of the printing plates are alternately stacked, and conveying the extracted printing plate to a processing section, the apparatus comprising: an interleaf sheet removal device that is actuated when an interleaf sheet is disposed at the top of the stack and removes the interleaf sheet; movable bodies, each of which are movable along a guide rail disposed between the cassette and the processing section; a holding member disposed at each of the movable bodies and movable towards and away from ends of the printing plates in the cassette opposite to ends disposed near the processing section, the holding member holding the uppermost printing plate as the holding member is moved towards the uppermost printing plate and separating the uppermost printing plate from an underlying printing plate as the holding member is moved away; separation members provided at end corners of the cassette opposite to end corners disposed near the processing section, the separation members curving the uppermost printing plate while the holding member separates the uppermost printing plate from the underlying printing plate, and making air enter between the uppermost printing plate and the underlying printing plate, thereby improving separation of the uppermost plate from the underlying plate; a moving device for moving each of the movable bodies along the guide rail to the processing section while the holding member holds the uppermost printing plate; and a rotation device for rotating the uppermost printing plate held by the holding member at a predetermined radius of curvature while the movable bodies are moved by the moving device, such that the uppermost printing plate is inverted.

According to the apparatus of the second aspect, interleaf sheets and printing plates are alternately stacked in the cassette. Because of this structure, the printing plates and the interleaf sheets are alternately extracted. It suffices if the interleaf sheet removal device, which is actuated when the interleaf sheet is disposed at the top of the stack and removes the interleaf sheet, is added to the apparatus of the first aspect.

In the apparatus of the second aspect, plural cassettes are preferably stacked in a direction that is the same as the direction in which the printing plates and the interleaf sheets are stacked, and further comprising a device for retracting cassettes accommodating printing plates not in use, such that the cassette accommodating printing plates to be used faces the holding member or the interleaf sheet removal device.

In the apparatus of the second aspect, plural cassettes are stacked in the direction which is the same as the direction in which the printing plates are stacked. For example, when the cassettes are disposed parallel to a surface on which the apparatus is placed, the cassettes except the uppermost cassette are hidden by cassettes disposed above them. Therefore, cassettes other than the cassette accommodating printing plates to be conveyed to the processing section are retracted such that the cassette accommodating printing plates to be used faces the holding member. Namely, the cassette in use is not moved.

When the cassettes are stacked parallel to the surface on which the apparatus is placed as described above, it suffices if the cassettes accommodating printing plates not in use are moved parallel to the surface on which the apparatus is placed.

A third aspect of the present invention is a method for extracting and conveying a printing plate, comprising the steps of: (a) determining the size of a printing plate to be processed and selecting a cassette in which printing plates of the determined size are stacked; (b) controlling suckers for sucking and lifting an uppermost printing plate from the cassette; and (c) controlling a conveyance unit disposed near the cassette such that the printing plate is inverted and conveyed to a processing section.

DESCRIPTION OF THE PREFERRED EMBODIMENT

Figure 1:
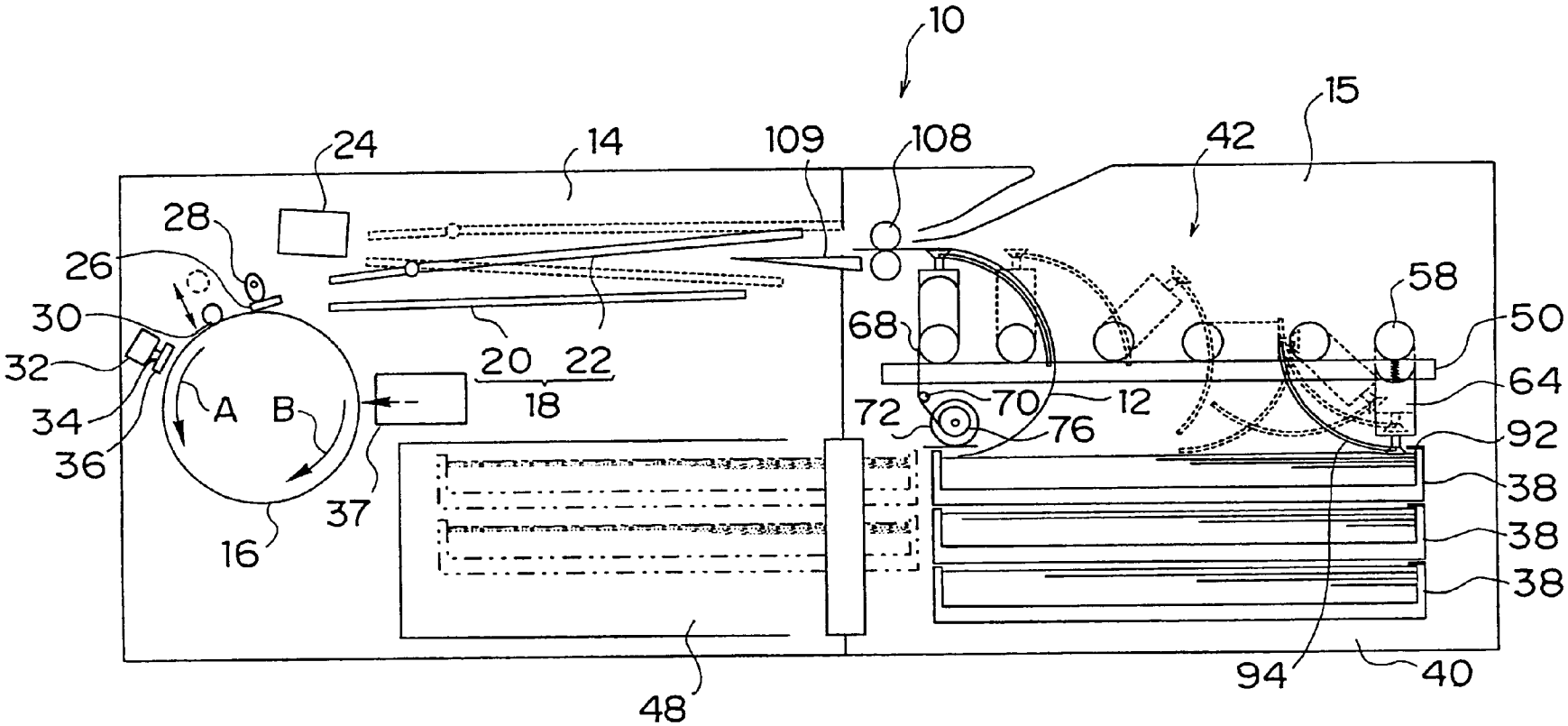
FIG. 1 is a schematic view of an apparatus for automatically exposing a printing plate relating to an embodiment of the present invention.

FIG. 1 shows an apparatus 10 for automatically exposing a printing plate 12 relating to the present embodiment.

The apparatus 10 includes two sections, namely, a section 14 for exposing the printing plate 12 imagewise by irradiating an image forming layer of the printing plate 12 with a laser beam, and a section 15 for extracting the printing plate 12 and conveying it to the exposure section 14. After the printing plate 12 has been exposed by the apparatus 10, the printing plate 12 is sent out to a development apparatus (not shown) adjacent to the apparatus 10.

Exposure Section

The exposure section 14 principally includes a rotating drum 16 having a peripheral surface around which the printing plate 12 is wound and held. The printing plate 12 is tangentially guided towards the outer periphery of the rotating drum 16 by a conveyance guide unit 18. The conveyance guide unit 18 comprises a feed guide 20 and a discharge guide 22. Conveyance rollers 108 and a guide plate 109 are disposed downstream from the sheet conveying section 15.

The feed guide 20 and the discharge guide 22 are disposed relative to each other so as to form a substantial horizontal "V" shape and swing at predetermined angles around a pivot point located at right ends of the feed guide 20 and the discharge guide 22 in FIG. 1. By this swing, left ends of the feed guide 20 or the discharge guide 22 can be selectively made to face the rotating drum 16, i.e., the feed guide 20 or the discharge guide 22 can be selectively disposed tangential to the rotating drum 16.

The printing plate 12 is conveyed from the conveyance section 15 onto the feed guide 20, which swings to face a puncher 24 disposed near the conveyance guide unit 18. The leading end of the printing plate 12 is thereby conveyed to the puncher 24, where a positioning notch is punched in the leading end of the printing plate 12.

After the notch has been punched by the puncher 24, the printing plate 12 is returned to the feed guide 20 and then moved to a position facing the rotating drum 16.

The rotating drum 16 is rotated by a drive (not shown) in a direction in which the printing plate 12 is mounted onto the rotating drum 16 and exposed, i.e., in a direction of arrow A in FIG. 1, and in a direction in which the printing plate 12 is dismounted, i.e., in a direction of arrow B in FIG. 1, which is opposite to the direction in which the printing plate 12 is mounted and exposed.

As shown in FIG. 1, a leading end chuck 26 is mounted at a predetermined position on the outer peripheral surface of the rotating drum 16. When the printing plate 12 is to be mounted onto the rotating drum 16, the rotating drum 16 is stopped at a position where the leading end chuck 26 faces the leading end of the printing plate 12, i.e., a "printing plate mounting position".

A mounting cam 28 is disposed at the printing plate mounting position so as to face the leading end chuck 26. One end of the leading end chuck 26 is pressed against the rotating drum 16 by rotating the mounting cam 28, whereby the printing plate 12 is interposed between the leading end chuck 26 and the peripheral surface of the rotating drum 16.

In the state in which the leading end of the printing plate 12 is interposed between the leading end chuck 26 and the rotating drum 16, by returning the mounting cam 28 to its original position and thereby releasing the press against the leading end chuck 26, the leading end of the printing plate 12 is nipped and held between the leading end chuck 26 and the peripheral surface of the rotating drum 16.

At this time, the printing plate 12 is positioned relative to the rotating drum 16 by a positioning pin (not shown), which protrudes from a predetermined position on the peripheral surface of the rotating drum 16, being inserted into the notch punched in the printing plate 12 by the puncher 24. The printing plate 12 may also be positioned by the positioning pin abutting against the leading end of the printing plate 12.

Once the leading end of the printing plate 12 is mounted onto the rotating drum 16, the rotating drum 16 is rotated in the direction of arrow A, whereby the printing plate 12 is wound onto the peripheral surface of the rotating drum 16.

A squeeze roller 30 is disposed in the vicinity of the peripheral surface of the rotating drum 16 and downstream from the printing plate mounting position in the direction of arrow A. The squeeze roller 30 is moved towards the rotating drum 16, to thereby press and closely adhere against the peripheral surface of the rotating drum 16.

A trailing end chuck mounting/dismounting unit 32 is disposed near the rotating drum 16 and downstream from the squeeze roller 30 in the direction of arrow A. The trailing end chuck mounting/dismounting unit 32 includes a shaft 34, which projects toward the rotating drum 16 and has a tip at which a trailing end chuck 36 is disposed.

When the trailing end of the printing plate 12 wound onto the rotating drum 16 faces the trailing end chuck mounting/dismounting unit 32, the shaft 34 is moved towards the rotating drum 16 to attach the trailing end chuck 36 at a predetermined position on the rotating drum 16. The trailing end of the printing plate 12 is thereby nipped and held between the trailing end chuck 36 and the rotating drum 16.

The squeeze roller 30 is retracted once the leading and trailing ends of the printing plate 12 are held on the rotating drum 16. Thereafter, while the rotating drum 16 is rotated at a predetermined high speed, a light beam modulated on the basis of image data is emitted from a recording head 37 synchronously with the rotation of the rotating drum 16. The printing plate 12 is thereby irradiated with and scan-exposed by the light beam on the basis of the image data.

When scan-exposure of the printing plate 12 is completed, the rotating drum 16 is temporarily stopped at a position where the trailing end chuck 36 faces the trailing end chuck mounting/dismounting unit 32. The trailing end chuck 36 is then dismounted from the rotating drum 16, thereby releasing the trailing end of the printing plate 12.

Subsequently, by the rotating drum 16 being rotated in the direction of arrow B, the printing plate 12 is discharged trailing end first to the discharge guide 22 in a direction tangential to the rotating drum 16. The printing plate 12 is thereafter conveyed to the development apparatus for further processing.

Extraction/Conveyance Section

Figure 2:
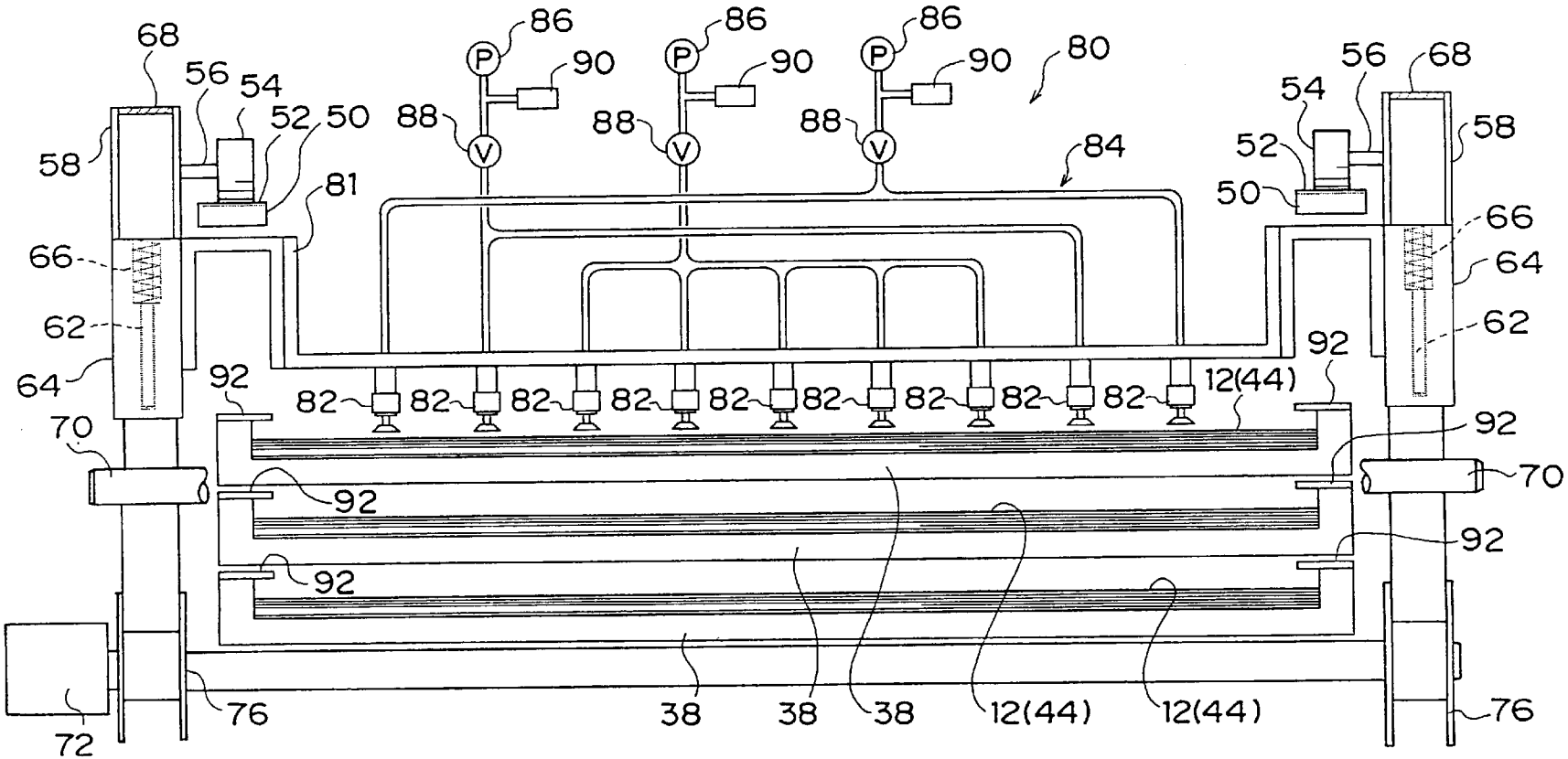
FIG. 2 is a right side view of the apparatus in FIG. 1.

As shown in FIGS. 1 and 2, the extraction/conveyance section 15 includes a cassette holder 40 in which the cassettes 38 are stacked substantially parallel to the surface on which the apparatus 10 is placed. Although the number of cassettes 38 accommodated in the cassette holder 40 in the present embodiment is three, the number of cassettes 38 accommodated is not limited thereto.

A conveyance unit 42 for extracting the printing plates 12 from the cassette 38 and conveying them to the exposure section 14 is disposed above the cassette holder 40.

Cassette and Cassette Retraction Mechanism

Figure 3:
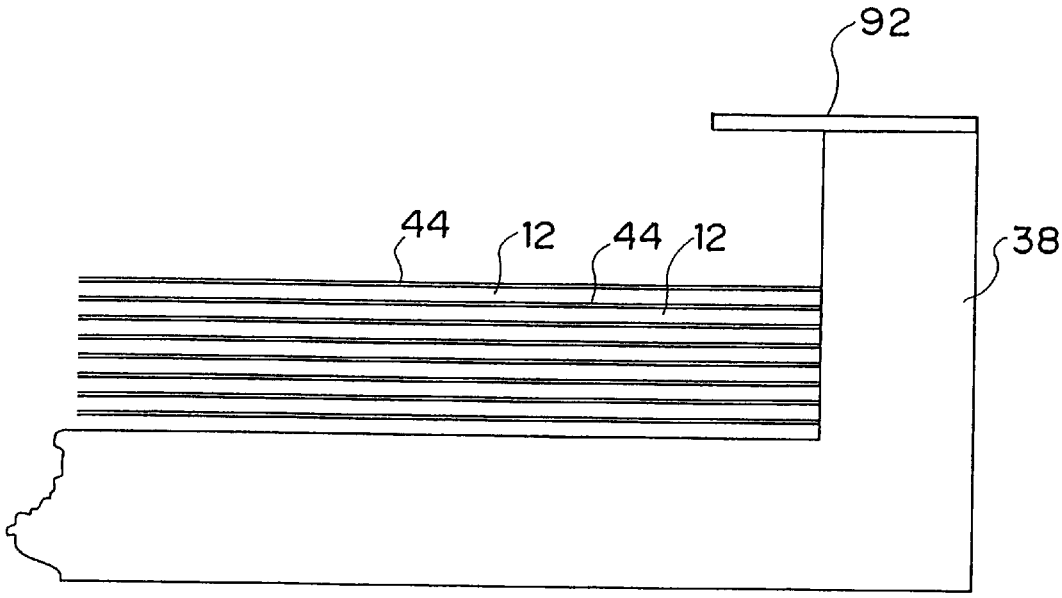
FIG. 3 is an enlarged view of a stack of printing plates and interleaf sheets accommodated in a cassette.

As shown in FIG. 3, a thin, film-like interleaf sheet 44 for protecting the image forming layer of the printing plate 12 is placed between respectively adjacent printing plates 12, and the printing plates 12 are stacked with the image forming layers thereof facing down, i.e., towards the surface on which the apparatus 10 is placed.

The printing plates 12 of different sizes can be respectively accommodated in the cassettes 38 so that printing plates 12 of a specified size are fed to the exposure section 14.

Figure 11B:
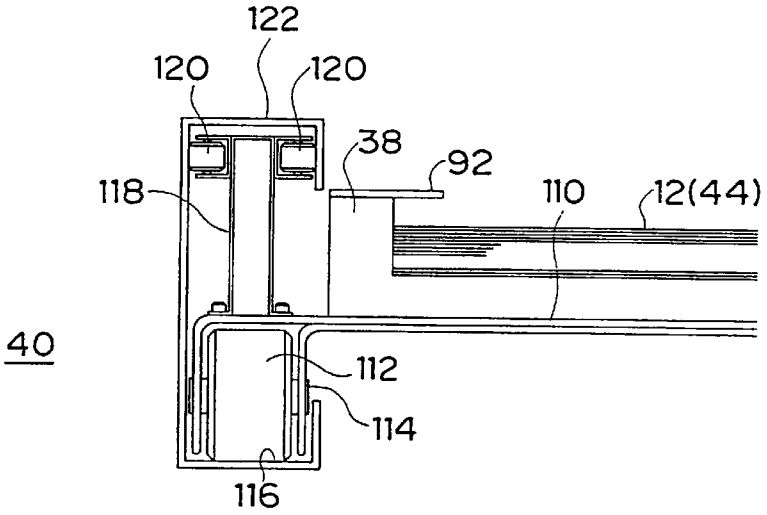
FIG. 11B is a right side view of the cassette retraction mechanism in FIG. 11A.
Figure 11A:
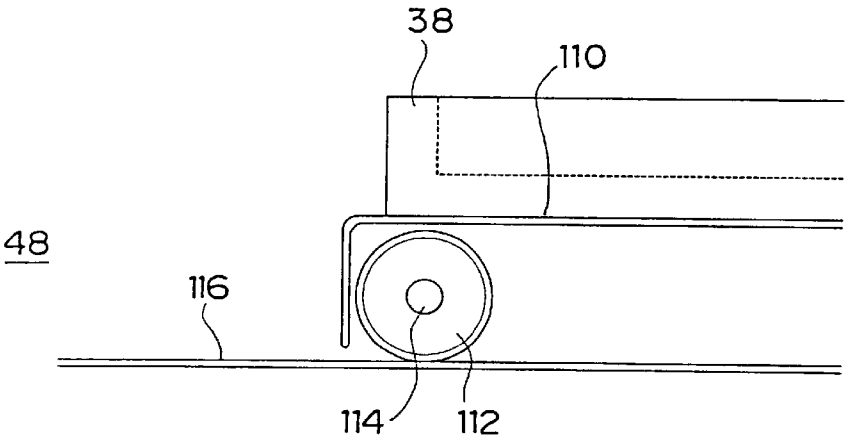
FIG. 11A is a front view of a cassette retraction mechanism.

Cassettes 38 other than the lowermost cassette can be independently moved horizontally. Namely, as shown in FIGS. 11A and 11B, the cassettes 38 are supported by a slide base 110. Support rollers 112 are mounted via shafts 114 to ends of the slide base 110 in a direction orthogonal to the direction in which the slide base 110 is slid, i.e., in a transverse direction of the slide base 110 and are supported on rails 116. The slide base 110 is moved or slid on the rails 116 with little frictional resistance.

Figure 9:
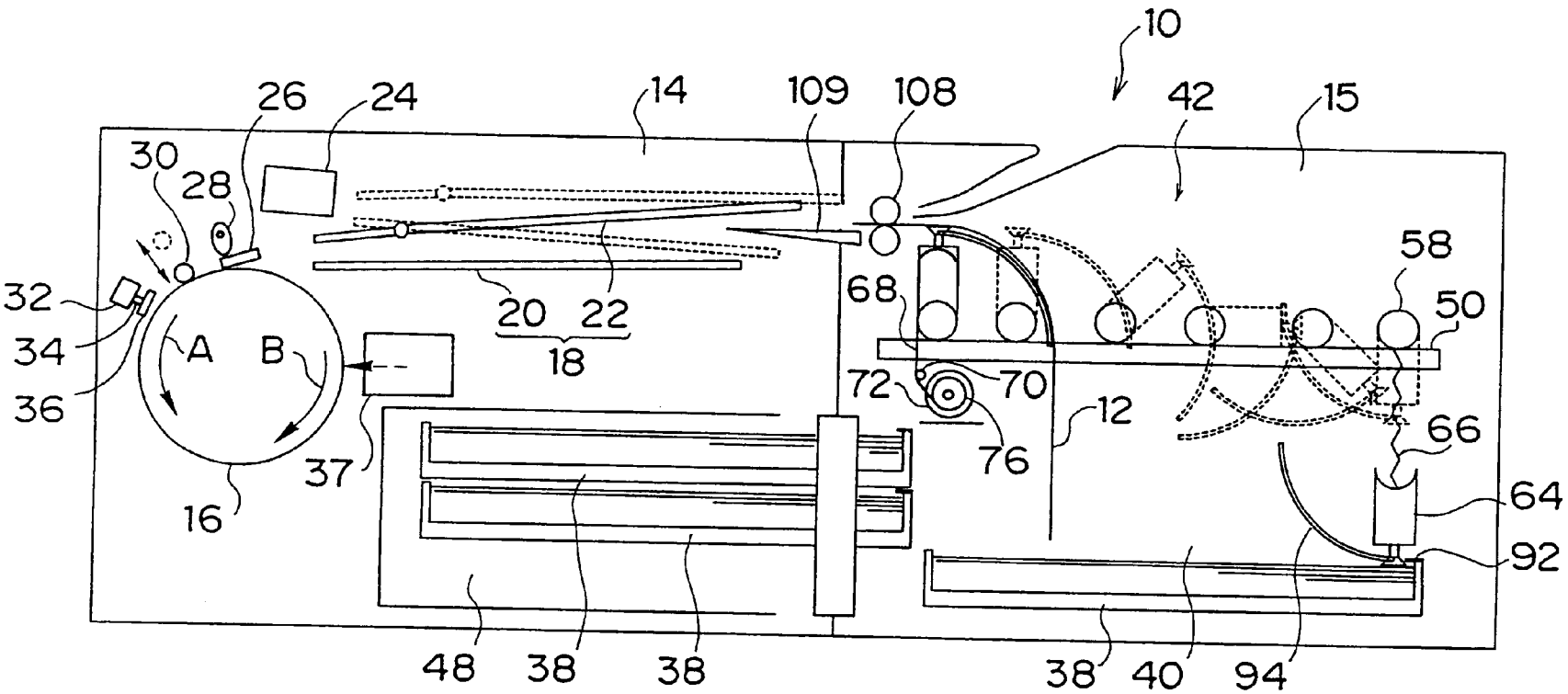
FIG. 9 is a front view of the apparatus in FIG. 1, showing a printing plate being extracted from a lowermost cassette (i.e., third cassette from the top).

A pair of transverse-direction guide rollers 120 is mounted via a bracket 118 above the part of the slide base 110 at which the supporting roller 112 is mounted. The transverse-direction guide rollers 120 are accommodated in a guide member 122 which extends up from the rail 116 to form a substantial horizontal "U" shape, and guide the slide base 110 in the transverse direction when it is moved. The rails 116 extend to a cassette retraction space 48 so that cassettes 38 accommodating printing plates 12 that are not in use can be horizontally moved along the rails 116 into the cassette retraction space 48. For example, when the printing plates 12 that are selected are those accommodated in the lowermost cassette 38, the other cassettes 38 are horizontally moved into the cassette retraction space 48. The positions into which the cassettes 38 accommodating printing plates 12 not in use are moved into the cassette retraction space are indicated in FIG. 1 by dotted lines and in FIG. 9 by solid lines.

In the present embodiment, the cassette 38 in use is not moved.

Conveyance Unit

The conveyance unit 42 is disposed above the cassette holder 40, and includes a pair of guide rails 50 disposed along a direction in which the printing plate 12 is conveyed, i.e., a horizontal direction in FIG. 1. The interval between the guide rails 50 is equal to or larger than the width of the printing plate 12 to allow the printing plate 12 to pass between the guide rails 50.

A toothed rack 52 is formed on the upper surface of each of the guide rails 50, and a pinion 54 meshes with the rack 52. A movable/rotatable body 58 that is coaxial to the pinion 54 is mounted to a rotating shaft 56 of each of the pinions 54. The movable/rotatable bodies 58 will be hereinafter described. Since the movable/rotatable bodies 58 provided at the pair of racks 52 have the same structure, only one movable/rotatable body 58 will be described.

A mechanism (not shown) for reducing the speed of the movable/rotatable body 58 at a predetermined deceleration ratio is disposed between the movable/rotatable body 58 and the rotating shaft 56. While the pinion 54 is moved from one end of the rack 52 to the other, the movable/rotatable body 58 is rotated 180°.

A guide rod 62 protrudes from the movable/rotatable body 58 in a radial direction thereof and is inserted into a bracket 64, whereby the bracket 64 is movable in the radial direction of the movable/rotatable body 58. A compression coil spring 66 is mounted on the guide rod 62 and urges the bracket 64 in a direction away from the movable/rotatable body 58.

Figure 4:
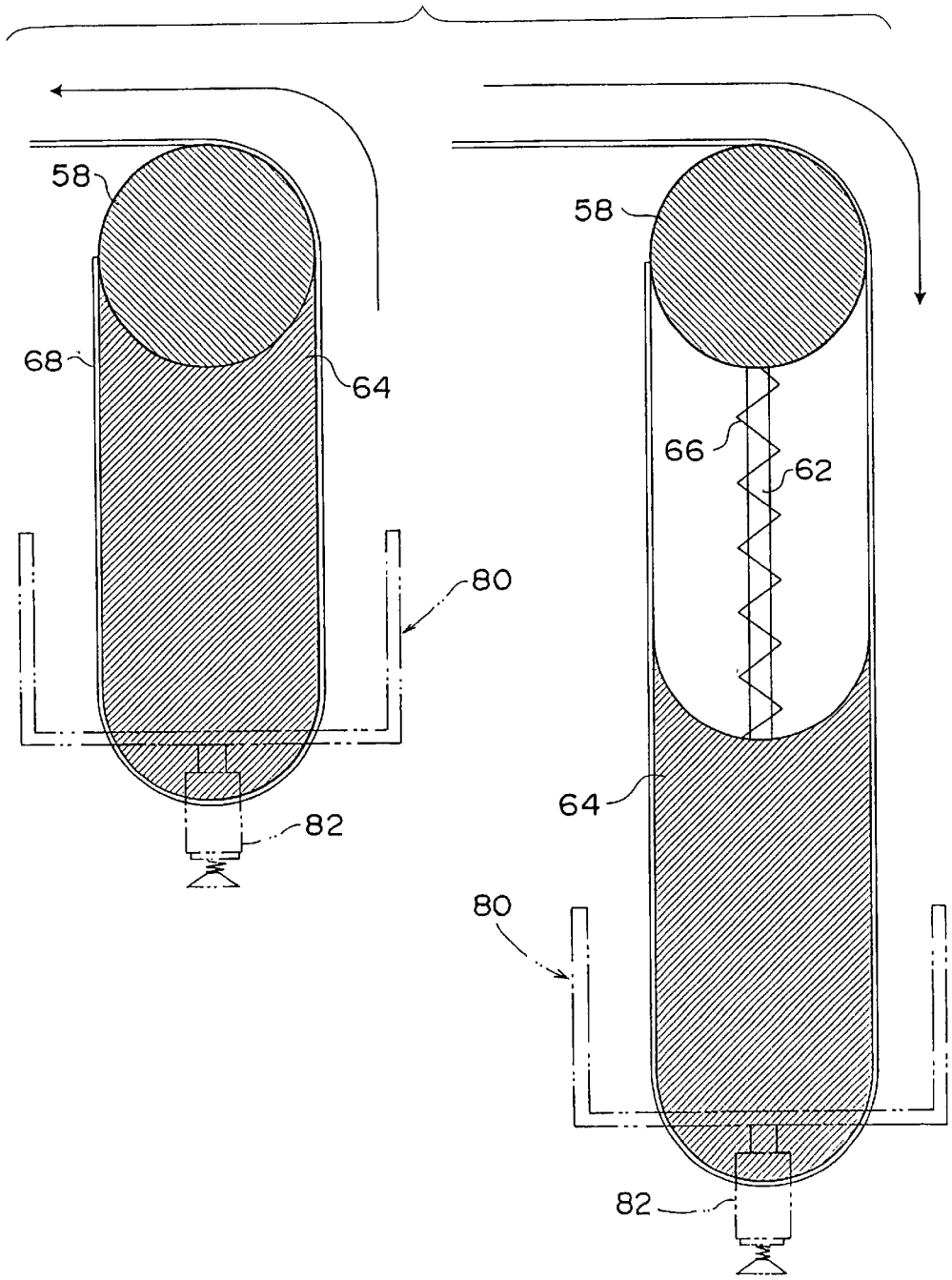
FIG. 4 is a front view showing the connection between a movable/rotatable body and a bracket, both of which serve as a raising/lowering mechanism of a sucker unit.

As shown in FIG. 4, an end of a belt or wire 68 is secured to an upper part of the left side of the bracket 64. The belt 68 extends down and around a lower part of the bracket 64, and then up along the right side of the bracket 64, and is wound around the movable/rotatable body 58. The belt 68 then extends along the guide rail 50 to the exposure section 14 side of the conveyance unit 42.

A pulley 70 is disposed below the end of the guide rail 50 near the exposure section 14. The belt 68 is wound onto the pulley 70 and then taken up by a reel 76 mounted to a rotating shaft of a motor 72.

When the motor 72 is driven to wind the belt 68 onto the reel 76, torque is transmitted to the movable/rotatable body 58 situated near the right end of the guide rail 50 in FIG. 1. The pinion 54 is rotated and moved along the rack 52 because of the torque.

The torque is transmitted to the pinion 54 so that the pinion 54 is rotated at a speed higher than the speed at which the movable/rotatable body 58 is rotated. Therefore, because of the tension, the movable/rotatable body 58 is rotated counterclockwise as shown in FIG. 1 while being moved along the guide rail 50. Moreover, as the movable/rotatable body 58 is rotated and moved to the left end of the guide rail 50 in FIG. 1, the bracket 64 is rotated 180° counterclockwise and moved from a position in which the bracket 64 is oriented downwards to a position in which the bracket 64 is disposed above the movable/rotatable body 58.

Figure 5:
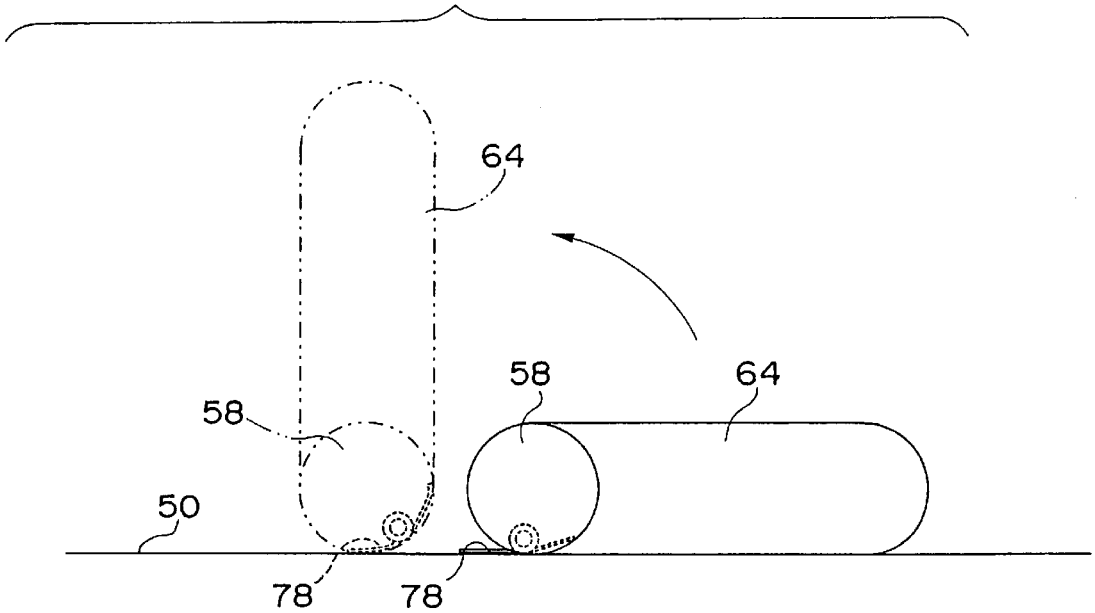
FIG. 5 is a front view showing movement of the movable/rotatable body and the bracket.

As shown in FIG. 5, a torsion coil spring 78 is mounted to the movable/rotatable body 58. One end of the torsion coil spring 78 is fixed to the movable/rotatable body 58, and the other end protrudes from the movable/rotatable body 58 in a direction tangential thereto. The protruding end of the torsion coil spring 78 contacts the guide rail 50 after the bracket 64 has been rotated 90° from the position in which the bracket 64 is oriented downwards. After making contact, the torsion coil spring 78 urges the movable/rotatable body 58 to rotate in a clockwise direction in FIG. 5, which is opposite to the direction in which the belt 68 is wound onto the reel 76 by the driving force of the motor 72.

When the motor 78 is driven to unwind the belt 68 from the reel 76, the bracket 64 and the movable/rotatable body 58 are rotated clockwise as shown in FIG. 1 by an urging force of the torsion coil spring 78.

As the belt 68 continues to be unwound from the reel 76, the movable/rotatable body 58 continues to rotate due to the weight of the bracket 64 itself. The pinion 54 is rotated along the rack 52 at a speed higher than the speed at which the movable/rotatable body 58 rotates, and is thus moved towards the right end of the guide rail 50 in FIG. 1 while the movable/rotatable body 58 and the bracket 64 are rotated 180°.

As the belt 68 is further unwound from the reel 76, the tension of the belt 68, by which the movable/rotatable body 58 and the bracket 64 are made to contact each other counter to the urging force of the compression coil spring 66, decreases, whereby the bracket 64 moves downwards along the guide rod 62 (FIG. 4). Namely, the position of the bracket 64 can be adjusted in accordance with the amount by which the belt 68 is loosened, so that the bracket 64 can be disposed at a position corresponding to the respective cassettes 38.

As shown in FIG. 2, a sucker unit 80 extends between the brackets 64. The sucker unit 80 includes a substantially U-shaped sucker bracket 81, a plurality of suckers 82 disposed beneath the sucker bracket 81 in a row along the transverse direction of the printing plate 12, and a plurality of suction pipes 84 which suck air through the suckers 82 to endow the suckers 82 with sucking force. The present embodiment employs nine suckers 82 and three systems of suction pipes 84.

The suction pipes 84 branch off so that ends thereof connect to the suckers 82. A magnetic pump 86 is mounted to each of other ends of the suction pipes 84.

A solenoid valve 88 and a negative pressure sensor 90 are disposed at each of the suction pipes 84.

The suckers 82 face the printing plate 12 accommodated in the cassette 38. When the belt 68 is unwound from the reel 76 and the bracket 64 moves downwards and away from the movable/rotatable bodies 58, the suckers 82 contact the right end (in FIG. 1) vicinity of the top surface of the printing plate 12. The top surface is opposite to the surface disposed with the image forming layer.

The positions or axes of the suckers 82 are always constant. However, since the cassettes 38 that are not in use are retracted in the cassette retraction space 48, the cassette 38 which has been selected for use can always be made to face the suckers 82.

While the printing plate 12 and the suckers 82 are in close contact with each other, a sucking force is applied through the suckers 82 by actuating the magnetic pumps 86, whereby the suckers 82 suck the printing plate 12. This close contact is detected by signals from the negative pressure sensors 90. When close contact is detected by the negative pressure sensors 90, the solenoid valves are closed, whereby close contact between the suckers 82 and the printing plate 12 can be maintained.

In this state, the uppermost printing plate 12 is lifted by moving up the brackets 64.

Figure 6A:
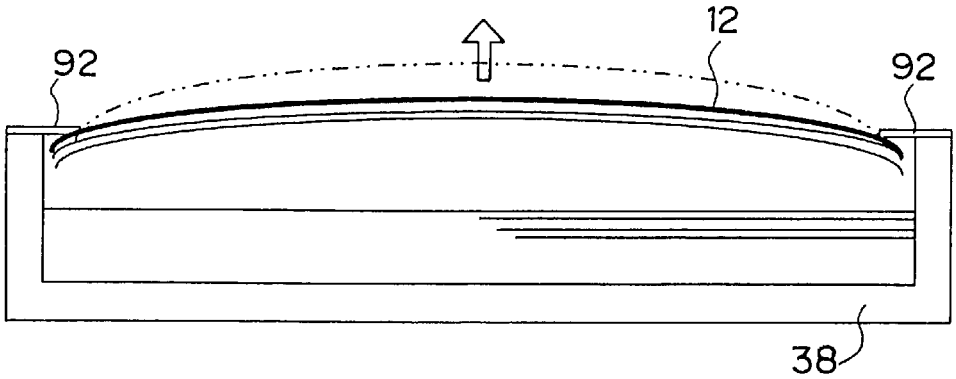
FIGS. 6A and 6B are right side views of the cassette, showing how the printing plate is extracted using separation plates.
Figure 6B:
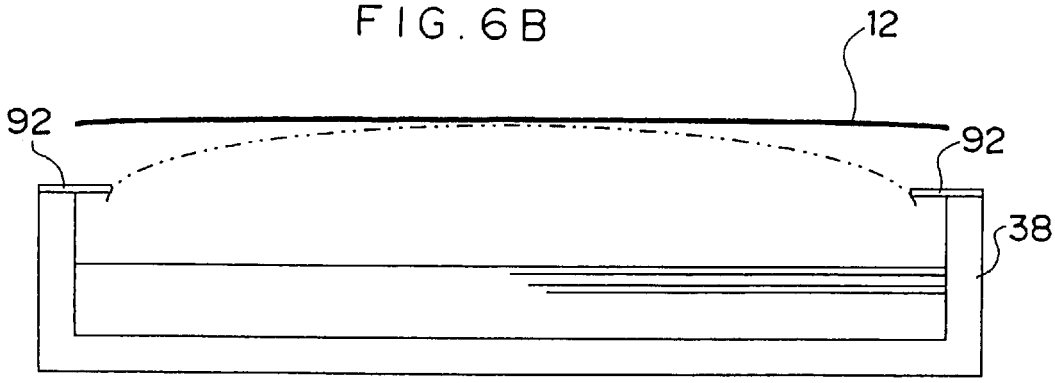

Separation plates 92 are attached to two corners at right ends of each cassette 38 in FIG. 1. The separation plates 92 are disposed at positions which interfere with the path along which the printing plate 12 is moved when it is taken out from the cassette 38. Namely, when the printing plate 12 is lifted by the suckers 82, the two corners of the printing plate 12 are prevented from being moved, and, as a result, the printing plate 12 is curved in the transverse direction (see FIG. 6A). By the printing plate 12 being curved, separation of the uppermost printing plate 12 from the underlying interleaf sheet 44 or printing plate 12 is improved. Thus, only the uppermost printing plate 12 is pulled through and over the separation plates 92, since the underlying interleaf sheet 44 or printing plate 12 is prevented from passing through the separation plates 92 (see FIG. 6B).

As shown in FIG. 1, an arc-shaped guide plate 94 is mounted to the brackets 64. The guide plate 94 forms ¼ of a circle, or ¼ of an oval or a parabola. The brackets 64 are rotated 180° around the movable/rotatable bodies 58 while the suckers 82 are sucking the printing plate 12. During the rotation of the brackets 64, the guide plate 94 serves as a guide surface which is turned over with the printing plate 12 being wound thereon (see chain lines in FIG. 1).

Interleaf Sheet Removal Mechanism

Figure 7A:
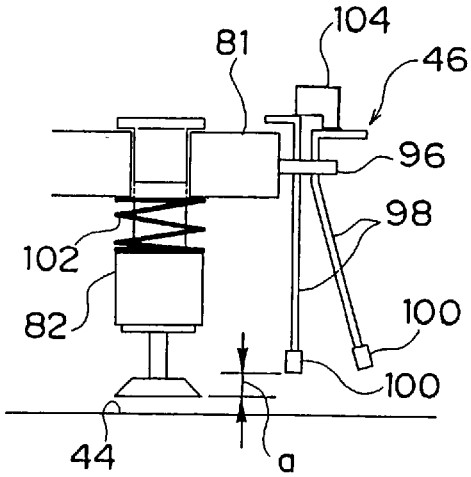
FIGS. 7A and 7B are front views showing an operation of a mechanism for removing an interleaf sheet disposed at the top of the stack.
Figure 7B:
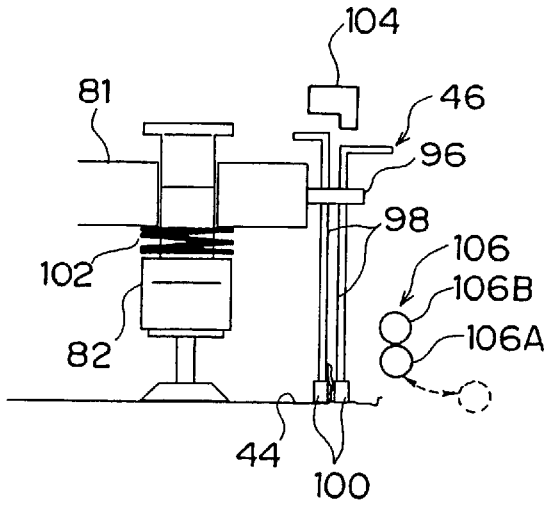

A mechanism 46 for removing the interleaf sheets 44 is disposed at the bracket 81 of the sucker unit 80. As shown in FIGS. 7A and 7B, the mechanism 46 includes a cylindrical guide body 96 attached to the bracket 81 and a pair of plate-like members 98 extending through and held in the cylindrical guide body 96. The plate-like members 98 are slidable with respect to the cylindrical guide body 96. One of the plate-like members 98 is straight, while the other is slightly bent so that a lower portion thereof in a longitudinal direction is gradually spaced away from the straight plate-like member 98. The bent plate-like member 98 serves as a plate spring, and is disposed near the end of the printing plate 12 (i.e., near the right end of the printing plate 12 in FIG. 1).

A pincher 100 made of rubber or a synthetic resin is attached to each lower end of each plate-like member 98. When the bracket 81 is moved down, the pinchers 100 abut against the interleaf sheet 44. Thereafter, when the bracket 81 is further moved down, only the cylindrical guide body 96 is moved. Accordingly, the bent plate-like member (the right member in FIG. 7A) is moved toward the straight plate-like member (the left member in FIG. 7A) along an arced path, and the pinchers 100 are made to contact each other, whereby the interleaf sheet 44 is pinched by the pair of pinchers 100 (FIG. 7B).

The bracket 81 is moved as described above only when the uppermost sheet in the cassette 38 is the interleaf sheet 44. When the uppermost sheet in the cassette 38 is the printing plate 12, the movement of the bracket 81 is stopped by the suckers 82 abutting against the printing plate 12.

While the brackets 64 are being moved up, the state in which the interleaf sheet 44 is pinched and held by the pinchers 100 is maintained. Therefore, the interleaf sheet 44 is pinched and separated from the underlying printing plate 12.

The relationship between the positions of the suckers 82 and the plate-like members 98 as shown in FIGS. 7A and 7B is as follows.

The leading end of the sucker 82 is extensible, and the sucker 82 is usually maintained in extension by urging force of the compression coil spring 102. In this state, sucking surfaces of the respective suckers 82 are positioned at the same height.

Moreover, lower end surfaces of the pinchers 100 are positioned somewhat higher than the positions of the extended suckers 82. The difference between the positions of the pinchers 100 and those of the suckers 82 is measured as "a".

Therefore, when the uppermost sheet of the stack in the cassette 38 is the printing plate 12 (the distinction between the interleaf sheet 44 and the printing plate 12 is made by a control system), even if the brackets 64 are moved downwards so that all of the suckers 82 closely contact the printing plate 12, the pinchers 100 do not contact the printing plate 12. The contact of the suckers 82 is detected by the negative pressure sensors 90.

When the uppermost sheet of the stack in the cassette 38 is the interleaf sheet 44, after the suckers 82 have abutted against the interleaf sheet 44, the brackets 64 further continue to move down. The suckers 82 are contracted counter to the urging force of the compression coil spring 102, and the pinchers 100 abut against the interleaf sheet 44.

When the brackets 64 further continue to move down, the cylindrical guide body 96 is moved toward the lower portion of the plate-like members 98. Therefore, the pinchers 100 are moved close to each other and pinch the interleaf sheet 44.

While the pinchers 100 pinch the interleaf sheet 44, the suckers 82 serve as holding members. Thus, the shorter edge of the interleaf sheet 44 is pulled with the pinchers 100. The shorter edge is the side of the interleaf sheet 44 close to the end. Accordingly, large resistance is not generated with respect to the pinchers 100.

Next, the brackets 64 are moved up with the interleaf sheet 44 being pinched by the pinchers 100. Since the relative positions of the cylindrical guide body 96 and the plate-like members 98 are the same, the pinchers 100 continue to pinch the interleaf sheet 44, whereby the uppermost interleaf sheet 44 is removed from the cassette 38.

A stopper 104 is disposed above the plate-like members 98 and on a path along which upper ends of the plate-like members 98 are moved when the brackets 64 are moved up. When the brackets 64 are moved up by a predetermined amount, the plate-like members 98 abut against the stopper 104 to prevent further upward movement of the plate-like members 98. Therefore, the plate-like members 98 are moved relative to the cylindrical guide body 96. In this way, pinching of the interleaf sheet 44 by the pinchers 100 is released.

A pair of rollers 106, which nip the pinched interleaf sheet 44 while the brackets 64 are moved up, is disposed. Of the roller pair 106, a lower roller 106A is movable toward and away from an upper roller 106B. The lower roller 106A is usually spaced apart from the upper roller 106B, but is moved close thereto once the pinched interleaf sheet 44 contacts the upper roller 106B. In this way, the interleaf sheet 44 can be nipped by the roller pair 106.

The roller pair 106 is then moved out of a casing or to the right in FIG. 1 by the drive (not shown).

Figure 8A:
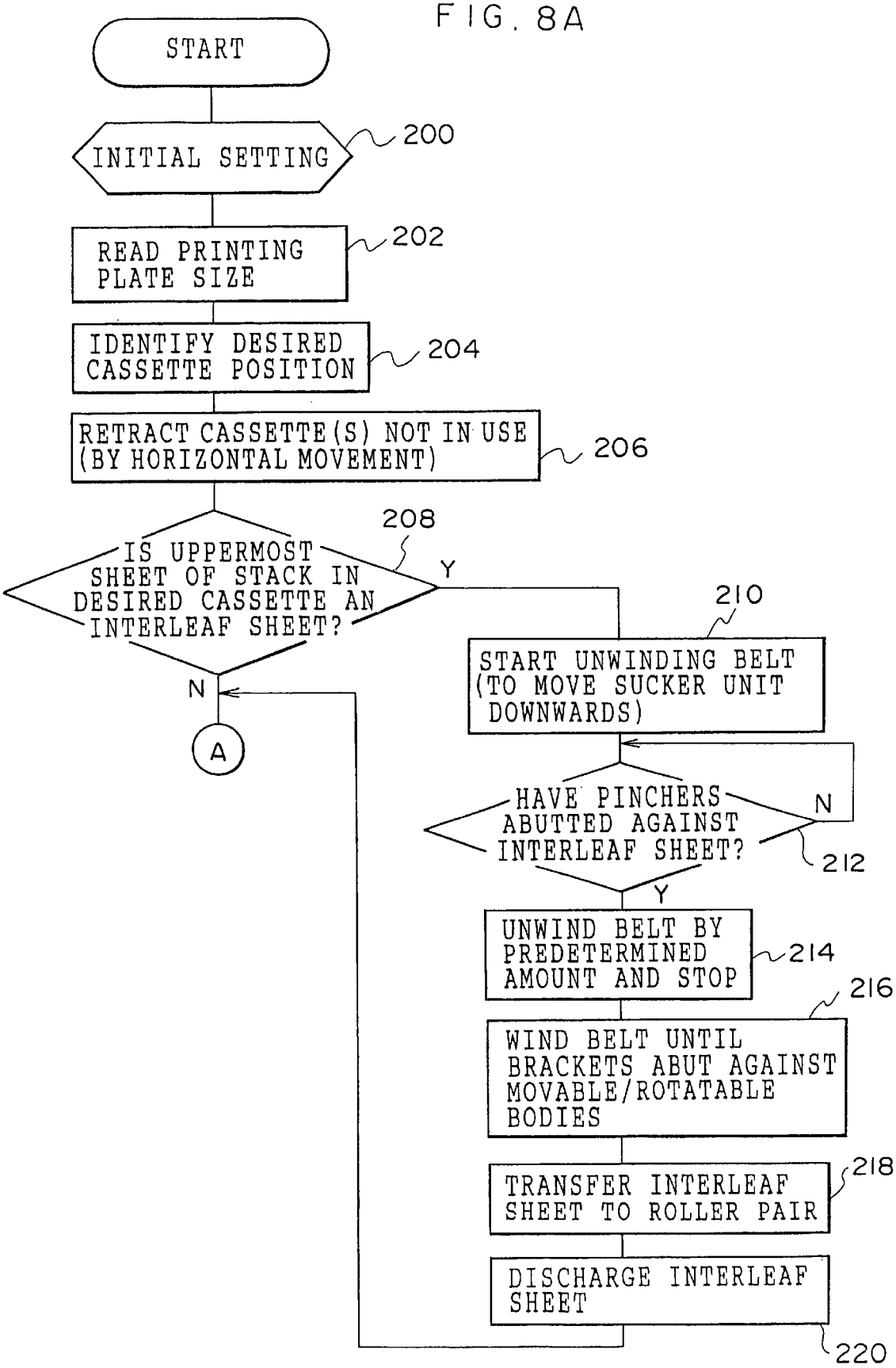
FIGS. 8A and 8B illustrate a flow chart showing a process carried out by the apparatus relating to the embodiment.
Figure 8B:
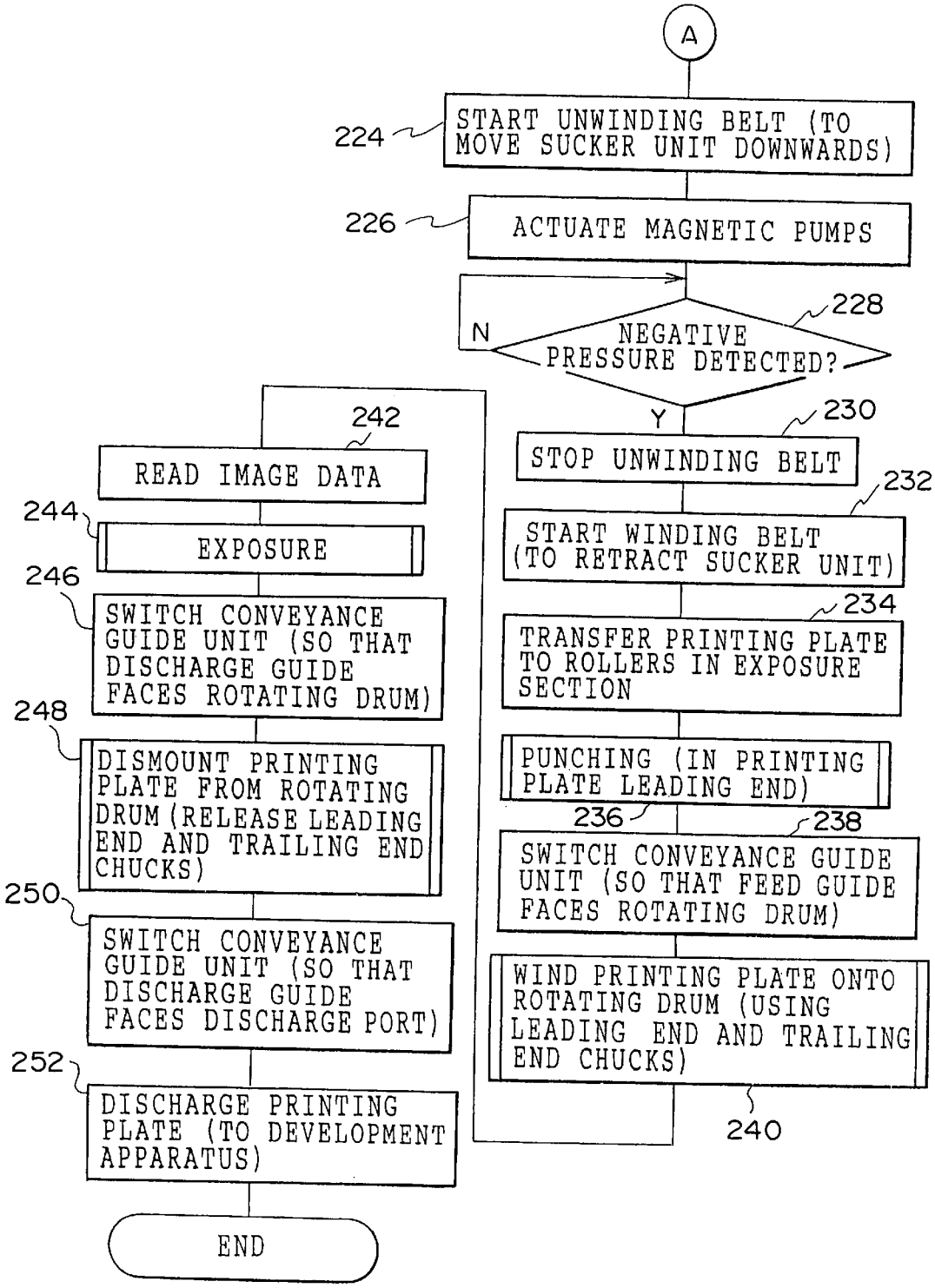

Hereinafter, the operation of the present embodiment will be described with reference to a flow chart in FIGS. 8A and 8B.

First, in step 200, initial setting of respective sections of the apparatus is carried out. Namely, the sucker unit 80 is disposed at the left ends of the guide rails 50 in FIG. 1 near the exposure section 14. The feed guide 20 of the conveyance guide unit 18 in the exposure section 14 is positioned to face the puncher 24.

In step 202, the size of the printing plate 12 to be processed is read. Thereafter, in step 204, the position of the cassette 38 accommodating the printing plates 12 of the size corresponding to the read size is identified.

Figure 10:
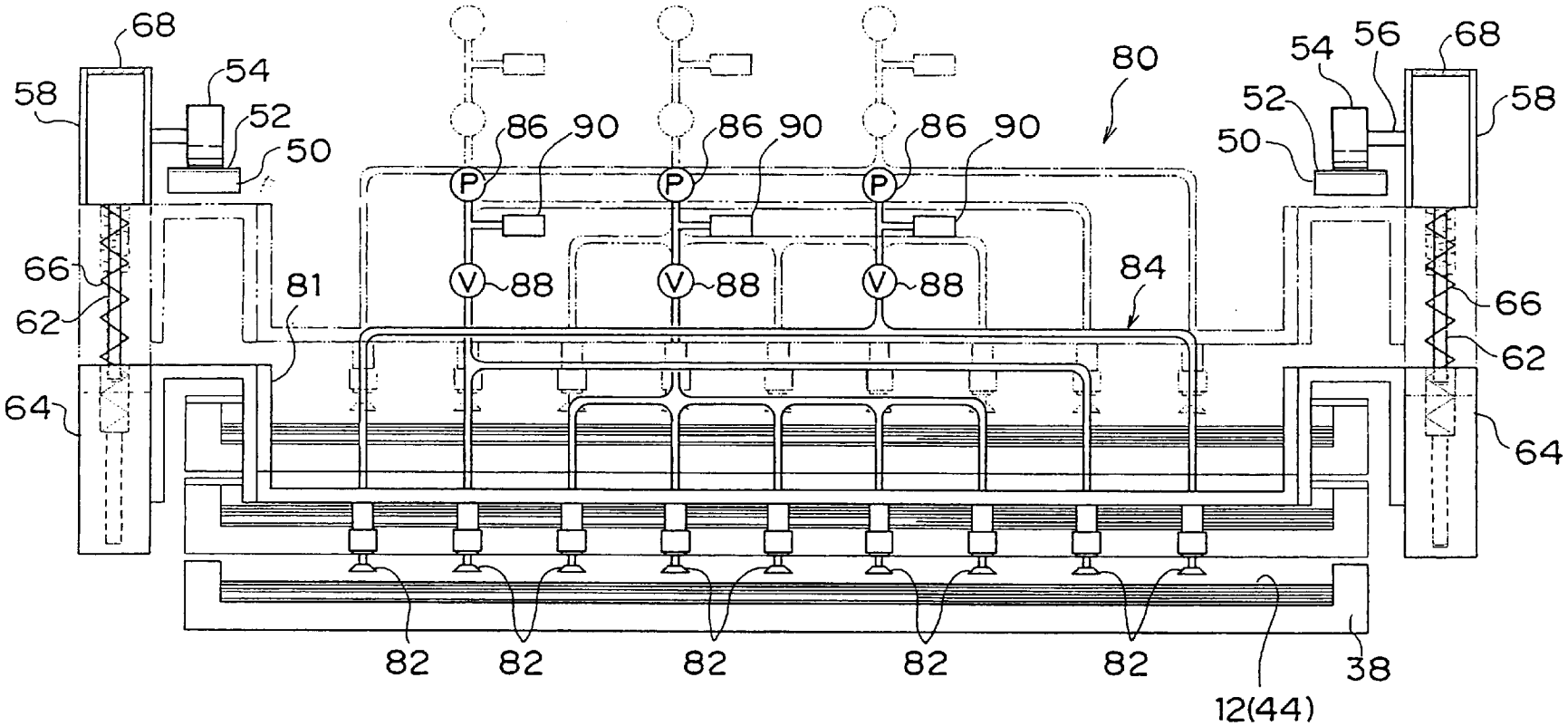
FIG. 10 is a right side view of the apparatus in FIG. 9.

In step 206, the cassettes 38 other than the identified cassette 38, namely, the cassettes 38 accommodating printing plates 12 that are not to be used are horizontally retracted into the cassette retraction space 48. For example, when the cassette 38 accommodating the printing plates 12 to be used is the uppermost cassette, this cassette 38 does not need to be retracted. When the cassette 38 accommodating the printing plates 12 to be used is the third cassette from the top, the uppermost cassette and the second cassette from the top are horizontally retracted into the cassette retraction space 48 (see FIGS. 9 and 10).

In step 208, it is determined whether the uppermost sheet of the stack in the selected cassette 38 is the interleaf sheet 44 or the printing plate 12. This determination may be carried out by using a reflection sensor (not shown) to detect a difference in reflectance in a non-contacting manner or by using a contact sensor to detect a difference in conductivity.

When the determination in step 208 is affirmative, the uppermost sheet in the cassette 38 is the interleaf sheet 44. The process proceeds to step 210 where removal of the interleaf sheet 44 from the cassette 38 is started. Namely, in step 210, normal rotation of the motor 72 is carried out so that the belt 68 begins unwinding.

Once the belt 68 begins unwinding, the movable/rotatable bodies 58 are rotated clockwise as shown in FIG. 1 by urging force of the torsion coil springs 78 mounted to the movable/rotatable bodies 58. Along with this rotation, the brackets 64 are rotated about 90° such that the longitudinal portions of the brackets 64 are disposed along the horizontal direction, i.e., parallel to the guide rails 50. Thereafter, the brackets 64 further rotate due to their own weight or moment. Further, along with the rotation of the brackets 64, the pinions 54 are rotated on the racks 52 at an accelerated speed. Therefore, the movable/rotatable bodies 58 and the brackets 64 are moved along the guide rails 50 to the right in FIG. 1. By the time the pinions 54 reach the right ends of the guide rails 50 in FIG. 1, the brackets 64 are rotated 180° around the movable/rotatable bodies 58. Further rotation of the pinions 54 is prevented. However, since the belt 68 continues to unwind, the brackets 64 move downwards and away from the movable/rotatable bodies 58.

Namely, the brackets 64 approach the cassette 38, and the suckers 82 abut against the upper surface of the interleaf sheet 44. The brackets 64 continue to move downwards. Along with this movement, the suckers 82 are contracted counter to urging force of the compression coil springs 66.

In step 212, when it is determined by detection with a sensor, for example, that the pinchers 100 have abutted against the upper surface of the interleaf sheet 44, the process proceeds to step 214 where the belt 68 is unwound by a predetermined amount and then stopped.

Due to the belt 68 being unwound by a predetermined amount in step 214, the cylindrical guide body 96 is moved down towards the lower portions of the plate-like members 98. Thus, the pinchers 100 are moved close to each other, thereby flexing and pinching the interleaf sheet 44.

In step 216, the belt 68 is wound until the brackets 64 abut against the movable/rotatable bodies 58. At this time, the lower roller 106A is spaced from the upper roller 106B and moved so as to contact the upper roller 106B once the brackets 64 contact the movable/rotatable bodies 58. In this way, the interleaf sheet 44 pinched by the pinchers 100 is transferred to between the roller pair 106 (step 218) and discharged out of the apparatus (step 220). The process then proceeds to step 224.

The process proceeds to step 224 when the determination in the previous step 208 is negative, namely, when the uppermost sheet of the stack in the cassette 38 is the printing plate 12. From step 224 onward, an operation for extracting the printing plate 12 is carried out.

The belt 68 begins unwinding in step 224. Since the brackets 64 are at the right ends of the guide rails 50 immediately after the interleaf sheet 44 has been discharged, the brackets 64 are spaced away or moved downwards from the movable/rotatable bodies 58 once the belt 68 has begun unwinding.

The magnetic pumps 86 are actuated in step 226. Next, in step 228, it is determined whether a predetermined negative pressure has been detected by the negative pressure sensors 90. Namely, as the brackets 64 are moved downwards, the suckers 82 approach the printing plate 12, and the sucking surfaces of the suckers 82 contact the upper surface, the non-image forming surface, of the printing plate 12. Therefore, the pressure within the suckers 82 becomes negative, thereby enabling sucking of the printing plate 12.

When it is determined in step 228 that a negative pressure has been detected, the process proceeds to step 230 where the belt 68 stops unwinding. At this time, the suckers 82 are in close contact with the printing plate 12. In step 232, the belt 68 is wound.

By winding the belt 68, the brackets 64 are moved upwards and approach the movable/rotatable bodies 58. Therefore, the uppermost printing plate 12 also is lifted by the suckers 82.

The printing plate 12 which has been lifted by the suckers 82 is curved by abutting against the separation plates 92, such that the central portion of the printing plate 12 in the transverse direction thereof, i.e., in the horizontal direction in FIG. 2 becomes convex. Air enters between the uppermost plate and the underlying plate due to the curve, thereby improving separation of the uppermost plate from the underlying plate.

Therefore, only the uppermost printing plate 12 is lifted over the separation plates 92 by the suckers 82.

Since the printing plate 12 is lifted in a cantilevered manner, the right end of the printing plate 12 in FIG. 1 is lifted. As the belt 68 continues to wind, the brackets 64 begin rotating counterwise. Along with this rotation, the pinions 54 are rotated while engaging with the racks 52. Therefore, the movable/rotatable bodies 58 and the brackets 64 are horizontally moved towards the left end of the guide rails 50.

The suckers 82 are disposed face up during the horizontal movement, and the printing plate 12 is inverted. Since the printing plate 12 is supported by the arc-shaped guide plate 94 during the inversion, load is not applied onto the suckers 82. Therefore, sucking force of the suckers 82 does not need to be increased more than necessary.

Further, approximately half of the printing plate 12 towards the end sucked by the suckers 82 is inverted along the substantially same path, while the other half of the printing plate 12 hangs down.

In this state, the leading end of the printing plate 12 is nipped between the conveyance rollers 108 and transferred onto the guide plate 109 (step 234). The leading end is the left end of the printing plate 12 in FIG. 1, since the printing plate 12 has been inverted. The printing plate 12 is then sent onto the feed guide 20.

In step 236, since the feed guide 20 faces the puncher 24, the leading end of the printing plate 12 is sent into the puncher 24 and punched. The printing plate 12 is then sent back onto the feed guide 20.

Next, in step 238, the conveyance guide unit 18 is switched so that the feed guide 20 faces the rotating drum 16, whereby the printing plate 12 is sent onto the rotating drum 16 along a direction tangential thereto.

The printing plate 12 is closely wound onto the peripheral surface of the rotating drum 16 by the leading end chuck 26 and the trailing end chuck 36 (step 240), thereby completing the positioning of the printing plate 12 for exposure.

In step 242, image data is read and the printing plate 12 is scan-exposed (step 244) by a light beam being emitted from the recording head 37 and irradiated onto the printing plate 12. Namely, the recording head 37 is moved in an axial direction of the rotating drum 16 while the rotating drum 16 is rotated at high speed as main scanning.

When exposure in step 244 is completed, the process proceeds to step 246, where the conveyance guide unit 18 is switched so that the discharge guide 22 faces the rotating drum 16. In step 248, the printing plate 12 which has been wound on the rotating drum 16 is discharged along a direction tangential thereto, and sent onto the discharge guide 22.

Once the printing plate 12 is sent onto the discharge guide 22, the process proceeds to step 250 where the conveyance guide unit 18 is switched so that the discharge guide 22 faces a discharge port. In step 252, the printing plate 12 is discharged to a development apparatus where the printing plate 12 is subsequently developed.

According to the present embodiment, separation of the uppermost printing plate 12 is improved by disposing the separation plates 92 at the corners of the cassette 38, such that air enters between the uppermost printing plate 12 and the underlying printing plate 12 or the interleaf sheet 44 when the uppermost printing plate 12 is extracted from the cassette 38.

Further, the movable/rotatable bodies 58 are moved along the guide rails 50 and rotated 180° within the moving ranges so as to be slower than the pinions 54. Therefore, the brackets 64 for supporting the suckers 82 are inverted, and the printing plate 12, whose image forming surface has been facing down, is sent into the exposure section 14 with the image forming surface facing up. Accordingly, the printing plate 12 is extracted from the cassette 33 and conveyed to the exposure section 14 in one operation.

As described above, the present invention has the following excellent effects. When the uppermost printing plate is to be taken out from a cassette accommodating a stack of printing plates, the uppermost printing plate is reliably separated from an underlying printing plate or an interleaf sheet. Further, the printing plate is conveyed without scratches being formed on the image forming layer thereof. Furthermore, the conveyance path, along which the printing plate is conveyed by rollers to a section for further processing is shortened. Additionally, the printing plate can be extracted, inverted, and conveyed to a section for further processing in one operation.

What is claimed is:

1. An apparatus for extracting an uppermost printing plate from a cassette in which printing plates are stacked and conveying the extracted printing plate to a processing section, the apparatus comprising:

movable bodies, each of which are movable along a guide rail adapted to be disposed between the cassette and the processing section;

a holding member disposed at each of the movable bodies and adapted to be movable towards and away from ends of the printing plates in the cassette opposite to ends disposed near the processing section, the holding member holding the uppermost printing plate as the holding member is moved towards the uppermost printing plate and separating the uppermost printing plate from an underlying printing plate as the holding member is moved away;

separation members adapted to be provided at end corners of the cassette opposite to end corners disposed near the processing section, the separation members curving the uppermost printing plate while the holding member separates the uppermost printing plate from the underlying printing plate;

a moving device for moving each of the movable bodies along the guide rail to the processing section while the holding member holds the uppermost printing plate;

a rotation device for rotating the uppermost printing plate held by the holding member at a predetermined radius of curvature while the movable bodies are moved by the moving device, such that the uppermost printing plate is inverted; and a device for retracting cassettes accommodating printing plates not in use, such that the cassette accommodating printing plates to be used faces the holding member.

2. The apparatus of claim 1, wherein the apparatus is adapted to accommodate plural cassettes which are stacked in a direction that is the same as the direction in which the printing plates are stacked.

3. The apparatus of claim 2, wherein the retraction device includes a slide base for supporting the cassette so that the cassette is horizontally movable, a support base mounted under the slide base and extending in a direction orthogonal to the horizontal direction in which the cassette is moved, and a rail for supporting the slide base via the support base.

4. The apparatus of claim 1, wherein each of the movable bodies includes a movable/rotatable body mechanically connected to the guide rail, and a bracket, into which a guide rod extending in a radial direction of the movable/rotatable body is inserted, with the bracket being movable in the radial direction.

5. The apparatus of claim 4, wherein the holding member includes suckers.

6. The apparatus of claim 5, wherein the rotation device includes a belt, with one end of the belt being secured to an upper side of the bracket, the belt being wound on each of the movable bodies, extending along the guide rails to a position near the processing section, and being taken up by a reel mounted to a rotating shaft of a motor via a pulley.

7. The apparatus of claim 1, wherein the moving device includes a rack formed on the upper surface of the guide rail, a pinion which meshes with the rack, and a motor for rotating and moving the pinion along the rack.

8. An apparatus for extracting an uppermost printing plate from a cassette, in which printing plates and interleaf sheets for protecting image forming surfaces of the printing plates are alternately stacked, and conveying the extracted printing plate to a processing section, the apparatus comprising:

an interleaf sheet removal device that is actuated when an interleaf sheet is disposed at the top of the stack and removes the interleaf sheet;

movable bodies, each of which are movable along a guide rail adapted to be disposed between the cassette and the processing section;

a holding member disposed at each of the movable bodies and adapted to be movable towards and away from ends of the printing plates in the cassette opposite to ends disposed near the processing section, the holding member holding the uppermost printing plate as the holding member is moved towards the uppermost printing plate and separating the uppermost printing plate from an underlying printing plate as the holding member is moved away;

separation members adapted to be provided at end corners of the cassette opposite to end corners disposed near the processing section, the separation members curving the uppermost printing plate while the holding member separates the uppermost printing plate from the underlying printing plate;

a moving device for moving each of the movable bodies along the guide rail to the processing section while the holding member holds the uppermost printing plate;

a rotation device for rotating the uppermost printing plate held by the holding member at a predetermined radius of curvature while the movable bodies are moved by the moving device, such that the uppermost printing plate is inverted; and a device for retracting cassettes accommodating printing plates not in use, such that the cassette accommodating printing plates to be used faces the holding member or the interleaf sheet removal device.

9. The apparatus of claim 8, wherein the apparatus is adapted to accommodate plural cassettes which are stacked in a direction that is the same as the direction in which the printing plates and the interleaf sheets are stacked.

10.The apparatus of claim 8, wherein each of the movable bodies includes a movable/rotatable body mechanically connected to the guide rail, and a bracket, into which a guide rod extending in a radial direction of the movable/rotatable body is inserted, with the bracket being movable in the radial direction.

11. The apparatus of claim 10, wherein the holding member includes suckers.

12. The apparatus of claim 11, wherein the rotation device includes a belt, with one end of the belt being secured to an upper side of the bracket, the belt being wound on each of the movable bodies, extending along the guide rails to a position near the processing section, and being taken up by a reel mounted to a rotating shaft of a motor via a pulley.

13. The apparatus of claim 8, wherein the moving device includes a rack formed on the upper surface of the guide rail, a pinion which meshes with the rack, and a motor for rotating and moving the pinion along the rack.

14. The apparatus of claim 8, wherein the retraction device includes a slide base for supporting the cassette so that the cassette is horizontally movable, a support base mounted under the slide base and extending in a direction orthogonal to the horizontal direction in which the cassette is moved, and a rail for supporting the slide base via the support base.

* * * * *